US011536101B2

(12) United States Patent
Sickels

(10) Patent No.: US 11,536,101 B2
(45) Date of Patent: Dec. 27, 2022

(54) REAL-TIME DRILLING-FLUID MONITOR

(71) Applicant: Robert Sickels, Mansfield, TX (US)

(72) Inventor: Robert Sickels, Mansfield, TX (US)

( * ) Notice: Subject to any disclaimer, the term of this patent is extended or adjusted under 35 U.S.C. 154(b) by 0 days.

(21) Appl. No.: 17/487,822

(22) Filed: Sep. 28, 2021

(65) Prior Publication Data

US 2022/0018198 A1 Jan. 20, 2022

Related U.S. Application Data

(63) Continuation-in-part of application No. 16/423,075, filed on May 27, 2019, now abandoned.

(60) Provisional application No. 62/682,146, filed on Jun. 7, 2018.

(51) Int. Cl.

| | |
|---|---|
| ***E21B 21/08*** | (2006.01) |
| ***E21B 21/06*** | (2006.01) |
| ***E21B 47/07*** | (2012.01) |

(52) U.S. Cl.

CPC ..... *E21B 21/062* (2013.01); *E21B 21/08* (2013.01); *E21B 47/07* (2020.05)

(58) Field of Classification Search

CPC ..... E21B 21/08; E21B 21/01; E21B 47/07; E21B 21/062; E21B 49/08

See application file for complete search history.

(56) References Cited

U.S. PATENT DOCUMENTS

| | | | | |
|---|---|---|---|---|
| 5,890,549 | A * | 4/1999 | Sprehe | E21B 21/01 169/69 |
| 6,415,877 | B1 * | 7/2002 | Fincher | E21B 7/128 175/25 |
| 9,518,434 | B1 * | 12/2016 | Champness | E21B 21/01 |
| 2018/0003654 | A1 * | 1/2018 | Chen | G01V 3/14 |
| 2019/0093468 | A1 * | 3/2019 | Aguirre | E21B 21/065 |

* cited by examiner

*Primary Examiner* — Yong-Suk (Philip) Ro

(74) *Attorney, Agent, or Firm* — D. Tiller Law PLLC; Donald Tiller

(57) ABSTRACT

Drilling-fluid monitoring technology for a drilling rig's drilling-fluid circulation system. Pairs of vertically separated pressure sensors are installed at various points in the circulation system, including at the bell nipple or flow line, to provide drilling-fluid density information at different points in the circulation system. The bell nipple/flow line sensors provide information about the height of the fluid in the bell nipple and the density of the drilling fluid before the cuttings are removed from the fluid. Changes in the bell-nipple drilling-fluid density or height may indicate potentially dangerous borehole conditions. Similarly, comparisons between bell-nipple drilling-fluid density with the density at other points in the circulation system provide information about the status of the circulation system. This information may be used to operate the drilling rig more safely and efficiently during the drilling process.

16 Claims, 6 Drawing Sheets

REAL-TIME DRILLING-FLUID MONITOR

CROSS-REFERENCE TO RELATED APPLICATIONS

This application is a continuation-in-part of U.S. patent application Ser. No. 16/423,075, filed on May 27, 2019, which claims the benefit of U.S. Patent Application No. 62/682,146, filed on Jun. 7, 2018.

BACKGROUND

This invention pertains generally to technology for monitoring the drilling fluid while drilling a well to extract fluid deposits from subterranean formations (e.g., oil, gas, water). More specifically, systems and methods are provided for real-time monitoring of drilling fluid including at or near the point the drilling fluid returns to the surface with cuttings (e.g., at the bell nipple).

As is well known in the art, drilling fluids are used for a variety of purposes in drilling operations. Drilling fluid (aka drilling mud) is typically pumped into the drilled hole (the borehole) through the drill pipe and bit and the fluid returns to the surface in the annulus between the drill pipe and the borehole wall. The drilling fluid serves to, for example, cool and lubricate the drill bit, return drill cuttings to the surface, keep subterranean fluids from escaping through the borehole to reach the surface (pressure control), and to mechanically stabilize the borehole wall.

The drilling fluid's ability to return drill cuttings to the surface is a function of a variety of factors including the viscosity of the drilling fluid in the borehole, the cuttings size and density, and the rate at which the drilling fluid is circulated (the mud flow rate). (This list of factors is not meant to be exhaustive.) Failure to properly remove the cuttings may, for example, result in the drill pipe sticking in the hole. The viscosity of the drilling fluid in the borehole is a function of the viscosity of the fluid pumped into the borehole and the drill cuttings carried in the fluid.

The drilling fluid's pressure-control capability is a function of a variety of factors including the density of the drilling fluid in the borehole, the size and shape of the return annulus, and the rate at which the drilling fluid is circulated. (This list of factors is not meant to be exhaustive.) For example, the higher the density of the drilling fluid, the more pressure it exerts on the borehole walls (and the pressure increases with vertical depth). If, at a particular depth in the borehole, the pressure of the drilling fluid is less than the pore pressure, formation fluids can escape to the surface and the well will "kick" potentially dangerous fluids. This can lead to catastrophic consequences. If the pressure of the drilling fluid is greater than the formation's fracture pressure, the formation may fracture and drilling fluid may escape into the formation. This may result in a reduced drilling-fluid pressure (which can lead to kicks) and loss of returns to the surface. It is important to maintain the drilling fluid pressure at the proper level for the formation conditions. Thus, it is important to have the appropriate drilling-fluid density for formation, drilling, and circulating conditions.

The density of the drilling fluid in the borehole is a function of the density of the fluid pumped into the borehole and the drilling cuttings carried in the fluid (along with other factors, such as formation fluids that enter the borehole fluid). Typically, cuttings are removed (if only partially) from the drilling fluid that returns to the surface before the drilling fluid is pumped back into the drill pipe. Measurements of drilling-fluid density are typically done after the cuttings are removed and thus provide imperfect information about the downhole drilling-fluid density.

Accordingly, there is a need for drilling-fluid-monitoring technology to provide better information regarding drilling-fluid conditions at various points in the drilling-fluid circulation system.

SUMMARY

Circulation-system instrumentation according to the invention supplies information to drilling-rig operators (e.g., drillers, engineers) about the status and trends of drilling fluid in the circulation system. This information can be used by the operators to control the circulation system to better ensure safe and efficient drilling operations.

In one aspect of the invention, a drilling-fluid-circulation pipe configured to be installed to or as the bell nipple includes two pressure sensors. The sensors are vertically separated when the pipe is installed in the circulation system and are configured to provide two measures of drilling fluid pressure while drilling operations are proceeding. The sensors thus provide real-time information regarding the density of the drilling fluid returned to the surface before cuttings are removed from the fluid. In another aspect of the invention, the pipe includes viscosity sensors to provide real-time monitoring of the viscosity of the drilling fluid returned to the surface before cuttings are removed from the fluid. A drilling-fluid temperature sensor may be included (separate or as part of one of the other sensors).

In another aspect of the invention, pairs of vertically separated pressure sensors may be installed at other points in the circulation system to provide real-time monitoring of the circulating-drilling-fluid density. For example, a pair of sensors may be installed at the bell nipple to monitor drilling fluid returned from the borehole with cuttings. And a pair of sensors may be installed at the processing pit to monitor drilling fluid below the shale shaker. And a pair of sensors may be installed at the suction pit to monitor drilling fluid just before it is pumped into the well. These sensors provide real-time drilling-fluid information at various points in the circulation system and thus provide a better monitor of the status of the circulation system.

In another aspect of the invention, a method of monitoring a drilling-fluid circulation system includes collecting pressure information from a pair of vertically separated pressure sensors, calculating a difference in pressure between the two sensors, and using the pressure difference to infer information about the level and density of the drilling fluid. The density or level information is compared with predetermined density or level information to determine trends or problems in the circulation system. For example, the density from the pressure differential may be compared to a target density, to a previously determined pressure-differential density, or to density at another point in the circulation system. These comparisons can be used to determine whether to modify the circulation system (e.g., to seal the well to prevent a kick or to add solids or fluids to the drilling fluid).

BRIEF DESCRIPTION OF THE DRAWINGS

These and other features, aspects, and advantages of the present invention will become better understood with reference to the following description, appended claims, and accompanying drawings where:

DETAILED DESCRIPTION

Figure 1:
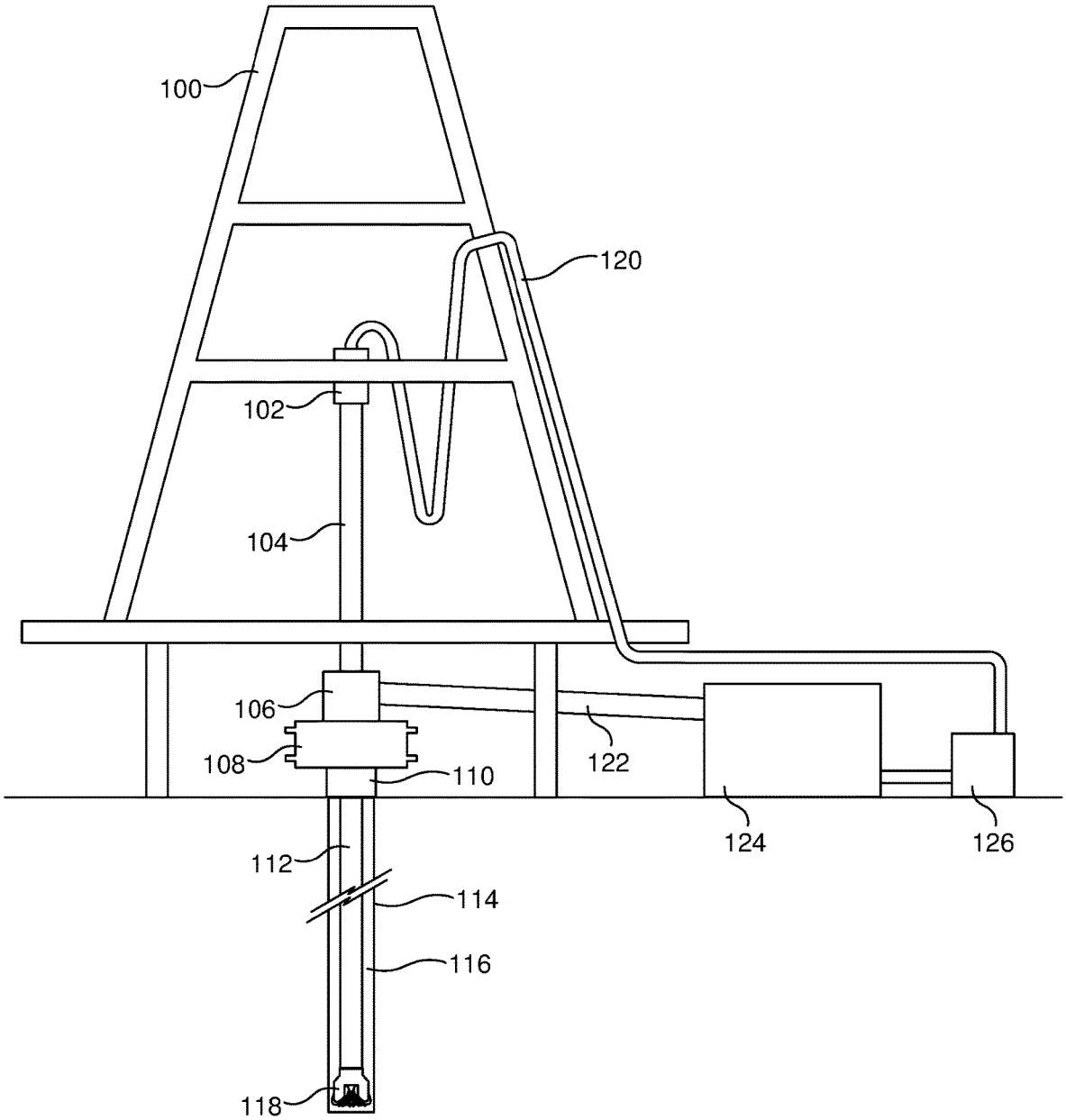
FIG. 1 illustrates the components of a typical drilling operation that are relevant to the understanding of the present invention.

In the summary above, and in the description below, reference is made to particular features of the invention in the context of exemplary embodiments of the invention. The features are described in the context of the exemplary embodiments to facilitate understanding. But the invention is not limited to the exemplary embodiments. And the features are not limited to the embodiments by which they are described. The invention provides a number of inventive features which can be combined in many ways, and the invention can be embodied in a wide variety of contexts. Unless expressly set forth as an essential feature of the invention, a feature of a particular embodiment should not be read into the claims unless expressly recited in a claim.

Except as explicitly defined otherwise, the words and phrases used herein, including terms used in the claims, carry the same meaning they carry to one of ordinary skill in the art as ordinarily used in the art.

Because one of ordinary skill in the art may best understand the structure of the invention by the function of various structural features of the invention, certain structural features may be explained or claimed with reference to the function of a feature. Unless used in the context of describing or claiming a particular inventive function (e.g., a process), reference to the function of a structural feature refers to the capability of the structural feature, not to an instance of use of the invention.

Except for claims that include language introducing a function with "means for" or "step for," the claims are not recited in so-called means-plus-function or step-plus-function format governed by 35 U.S.C. § 112(f). Claims that include the "means for [function]" language but also recite the structure for performing the function are not means-plus-function claims governed by § 112(f). Claims that include the "step for [function]" language but also recite an act for performing the function are not step-plus-function claims governed by § 112(f).

Except as otherwise stated herein or as is otherwise clear from context, the inventive methods comprising or consisting of more than one step may be carried out without concern for the order of the steps.

The terms "comprising," "comprises," "including," "includes," "having," "haves," and their grammatical equivalents are used herein to mean that other components or steps are optionally present. For example, an article comprising A, B, and C includes an article having only A, B, and C as well as articles having A, B, C, and other components. And a method comprising the steps A, B, and C includes methods having only the steps A, B, and C as well as methods having the steps A, B, C, and other steps.

Terms of degree, such as "substantially," "about," and "roughly" are used herein to denote features that satisfy their technological purpose equivalently to a feature that is "exact." For example, a component A is "substantially" perpendicular to a second component B if A and B are at an angle such as to equivalently satisfy the technological purpose of A being perpendicular to B.

Except as otherwise stated herein, or as is otherwise clear from context, the term "or" is used herein in its inclusive sense. For example, "A or B" means "A or B, or both A and B."

FIG. 1 depicts the relevant components of a drilling rig. A derrick 100 supports a swivel 102 that is connected to a Kelly 104 and a hose 120. The Kelly 104 is connected to a string of drill pipe/collars 112 that is connected to a drill bit 118. The hose 120 is connected to a pump 126 that is connected to a drilling-fluid processing system 124 which in turn is connected to a flow line 122 that is connected to a bell nipple 106. The bell nipple 106 is connected to a blowout preventer (BOP) 108 which is connected to a casing head (or wellhead) 110. In operation of the drilling rig, the drill bit 118 is rotated by rotating the drill pipe 112 to drill a borehole 116 defined by a borehole wall 114. FIG. 1 is meant to describe a typical environment for application of the invention. The invention is more broadly applicable than the environment depicted in FIG. 1. Whether the invention is applicable to a particular drilling environment is a function of the drilling-fluid circulation system rather than the type of rig. For example, the invention is suitable for use with top-drive or other drilling rigs having a similar circulation system. (The components are similar for a top-drive drilling rig except that the swivel 102 and Kelly 104 are replaced with a top drive and a quill.)

Figure 2:
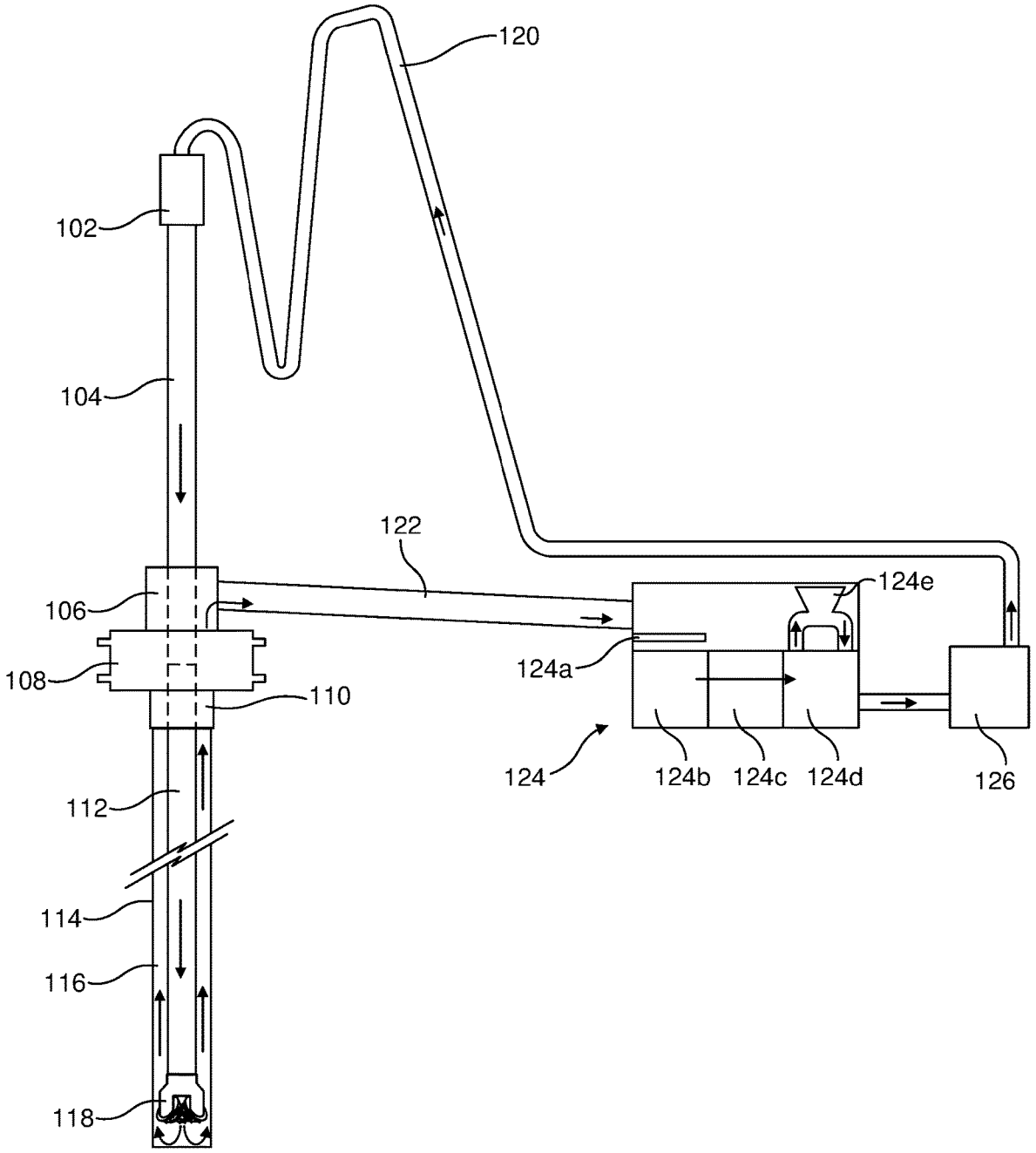
FIG. 2 illustrates the main components of a typical drilling-fluid circulation system.

FIG. 2 depicts operation of the drilling rig's drilling-fluid circulation system. Drilling fluid is pumped from the drilling-fluid processing system 124 (which includes a number of tanks or pits and other components) through the center of the drill pipe 112 out of the bit 118 and returns to the surface in the annulus between the drill pipe 112 and the borehole wall 114. At the surface, the returned drilling fluid flows out of the bell nipple 106 through a flow line 122 back to the drilling-fluid processing system 124. The arrows in the figures depict the direction of drilling-fluid flow during drilling operations.

In the typical desired operation, the drilling fluid that returns to the surface will include cuttings created by the drill bit 118 as it penetrates the earth. The returned drilling fluid—with cuttings—flows out the bell nipple 106 through the flow line 122 to the drilling-fluid processing system 124. The drilling-fluid processing system 124 cleans the drilling fluid by, among other things, removing the cuttings (at least partially). For example, the returned drilling fluid is run over a shale shaker **124*a* that removes coarse cuttings from the drilling fluid which is then contained in a processing pit 124*b* until further processed. (In the context of the circulation system, "pit" and "tank" are used synonymously. That is, a pit may be a fluid-containing hole dug in the ground, it may also be a container constructed of, for example, steel.) The drilling fluid may be further cleaned and processed through various components 124*c*, such as hyrdrocyclones, mud cleaners, and centrifuges. The cleaned drilling fluid is eventually contained in a suction pit 124*d*. The drilling fluid may be further processed by addition of products via a hopper 124***e*. A pump 126 moves fluid from the suction pit 124*d* through a hose 120 back through the drill pipe 112 and out the drill bit 118.

Figure 3:
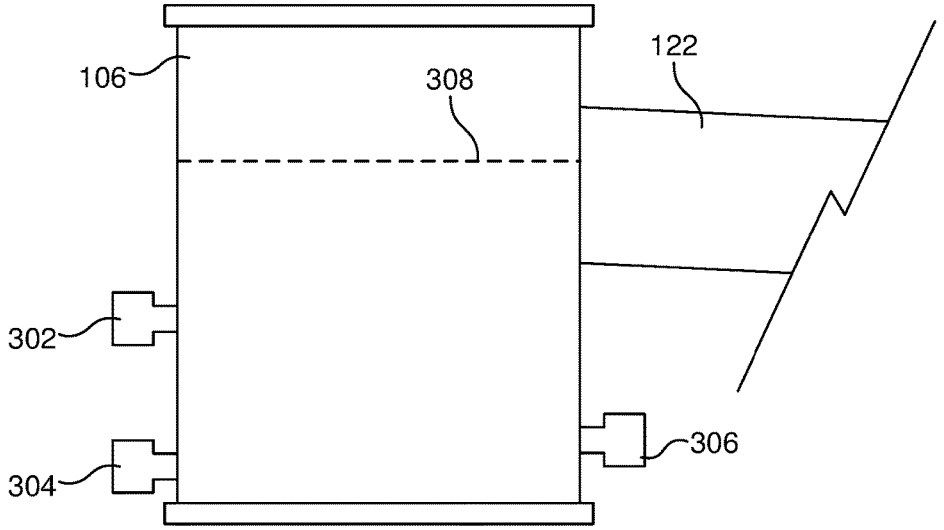
FIG. 3 illustrates an exemplary bell-nipple drilling-fluid monitor.

FIG. 3 depicts an exemplary bell-nipple drilling-fluid monitor according to the invention. The monitor includes two inline pressure sensors 302, 304 that are installed on the bell nipple 106 such that the first pressure sensor 304 is vertically lower than the second pressure sensor 302. (Together, the two pressure sensors 302, 304 are a pair of vertically separated pressure sensors.) Each pressure sensor 302, 304 is configured to provide a measure of pressure in the bell nipple 106.

The difference in pressure readings at the two sensors 302, 304 is indicative of the density of the drilling fluid in the bell nipple and can be used to estimate the height of the drilling-fluid surface above either of the sensors 302, 304 (the drilling-fluid surface is shown in the figure as a dashed line 308).

$$\text{density} \approx \frac{\Delta\text{pressure}}{k_1}$$

$$\text{height above } sensor_i \approx \frac{pressure_i}{\text{density} \times k_2}$$

Where $k_1$ is a factor that depends on gravity and the vertical separation of the sensors and $k_2$ is a factor that depends on gravity. The height above the sensor can be used to estimate the rate the drilling fluid flows into the flow line 122. For example, the flow rate through the flow line 122 can be estimated based on the Manning equation because the height of the fluid 308 provides a measure of the cross-sectional area of drilling-fluid in the flow line (because the distance between the flowline and the pressure sensors 302, 304 is known).

The measure of density of the drilling fluid in the bell nipple provides an indication of the downhole density of the drilling fluid in the annulus between the drill pipe 112 and the borehole wall 114. This can be used to determine the equivalent circulating density (ECD) which is a measure of the pressure exerted by the drilling fluid on the borehole wall 114.

Variance of density of the drilling fluid in the bell nipple as compared to previously measured densities or to the density of the drilling fluid at other points in the circulation system provide information about the status of the circulation system. For example, a decrease in bell-nipple drilling-fluid density may indicate an influx of formation fluid deposits (e.g., natural gas, water, or oil). This can indicate the circulation system is underbalanced: the pressure exerted by the drilling-fluid density is not sufficient to keep the formation fluids from entering the borehole and returning to surface. This could presage a dangerous well kick. Similarly, an increase in bell-nipple drilling-fluid density may indicate increased cuttings. This could indicate a washout or similar condition in which the borehole wall is collapsing and the integrity of the well is at risk.

The bell-nipple drilling-fluid monitor may also include an inline viscosity sensor 306. The viscosity sensor 306 is installed on the bell nipple 106 and is configured to provide a measure of viscosity of drilling fluid in the bell nipple 106. Variance in the viscosity (e.g., over time, compared to other points in the circulation system, compared to target) can indicate changing conditions. For example, certain cuttings may react with the injected drilling fluid to lower its viscosity. This lowers the drilling fluid's ability to return the cuttings to the surface and can jeopardize the entire drilling operation (e.g., sticking of the drill pipe in the borehole due to unremoved cuttings near the drill bit). (The viscosity sensor is depicted as a separate device, but it may equivalently be part of a pressure-sensor device.)

In the depicted exemplary embodiment, the bell-nipple drilling-fluid monitor has sensors installed on the bell nipple. Equivalently, the sensors may be installed on a pipe (tube) that attaches to the bell nipple and is part of the circulation circuit. Such a pipe effectively extends the bell nipple and, when connected to the bell nipple, is encompassed herein by the term "bell nipple."

The drilling-rig operator can use the information from the bell-nipple drilling-fluid monitor to modify circulation-system or drilling parameters. For example, products may be added to the drilling fluid to change the density or viscosity of the drilling fluid based on the density or viscosity at the bell nipple. Or the circulation rate (flow rate) of the drilling fluid can be decreased (e.g., to decrease pressure) or increased (e.g., to increase removal of cuttings). Or the penetration rate of the drill bit may be decreased to stabilize the borehole. In extreme circumstances, information from the bell-nipple drilling-fluid monitor may be used to rapidly shut down the well to prevent a kick by activating the blowout preventer by conventional means (e.g., application of a hydraulic pressure, application of an electronic signal, application of an acoustic signal). The term "blowout preventer" is used herein to refer to one or more blowout preventers in a stack.

Figure 4:
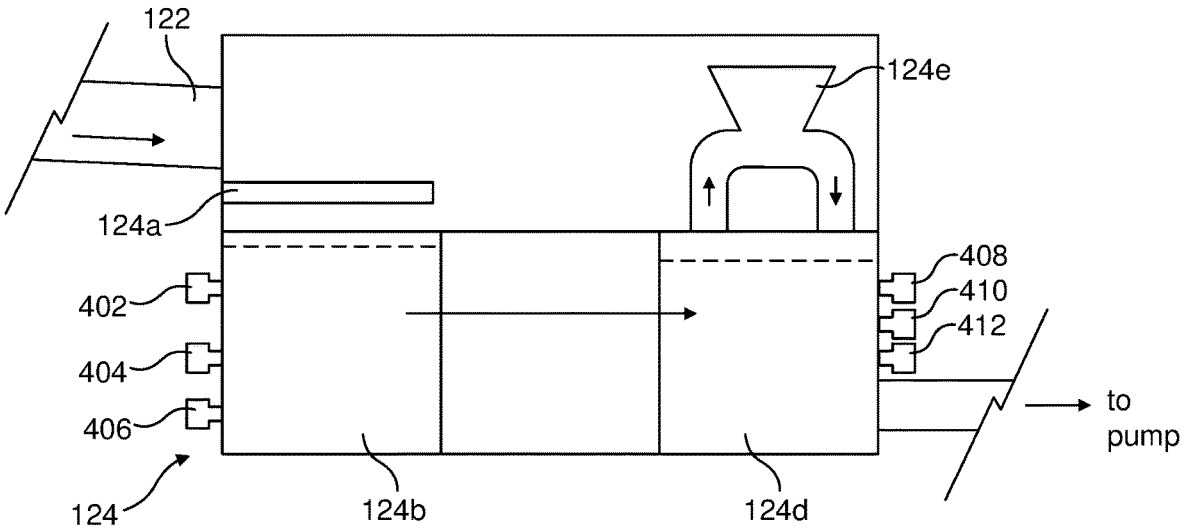
FIG. 4 illustrates a drilling-fluid processing system with an exemplary process-pit drilling-fluid monitor and an exemplary suction-pit drilling-fluid monitor.

FIG. 4 depicts an exemplary process-pit drilling-fluid monitor and an exemplary suction-pit drilling-fluid monitor according to the invention. The process-pit drilling-fluid monitor includes two pressure sensors 402, 406 that are installed on or disposed in the process-pit such that the first pressure sensor 406 is vertically lower than the second pressure sensor 402. Each pressure sensor 402, 406 is configured to provide a measure of pressure in the process pit 124*b*. The process-pit drilling-fluid monitor may also include a viscosity sensor 404. The suction-pit drilling-fluid monitor includes two pressure sensors 408, 412 that are installed on or disposed in the suction-pit such that the first pressure sensor 412 is vertically lower than the second pressure sensor 408. Each pressure sensor 408, 412 is configured to provide a measure of pressure in the suction pit 124*d*. The suction-pit drilling-fluid monitor may also include a viscosity sensor 410.

The process-pit drilling-fluid monitor and the suction-pit drilling-fluid monitor each operate as described with reference to the bell-nipple drilling-fluid monitor. Measures of pressure provide estimates of drilling-fluid density in the pits and the height of the drilling-fluid surface above the sensors (i.e., the level of drilling fluid in the pits).

The monitors provide information similar to the bell-nipple drilling-fluid monitor (namely, drilling-fluid density and height). Decreases in the level of the drilling fluid (i.e., a decrease in pit volume) can indicate problems in the circulation system, such as a loss of drilling fluid in the hole. Similarity between drilling-fluid density in the processing pit and drilling-fluid density at the bell nipple, or changes in the difference between drilling-fluid density in the processing pit and drilling-fluid density at the bell nipple, can indicate problems with the shale shaker 124*a* (e.g., a hole in a shaker screen that is allowing coarse cuttings to fall through into the processing pit). Such a problem can decrease the efficiency of the drilling-fluid-cuttings-removal process and can threaten the efficiency of the drilling operation overall. Information from the suction-pit drilling-fluid monitor is the baseline—it indicates properties of the drilling fluid entering the well. This information can be used to modify the drilling fluid by adding products through the hopper 124*e*.

Figure 5:
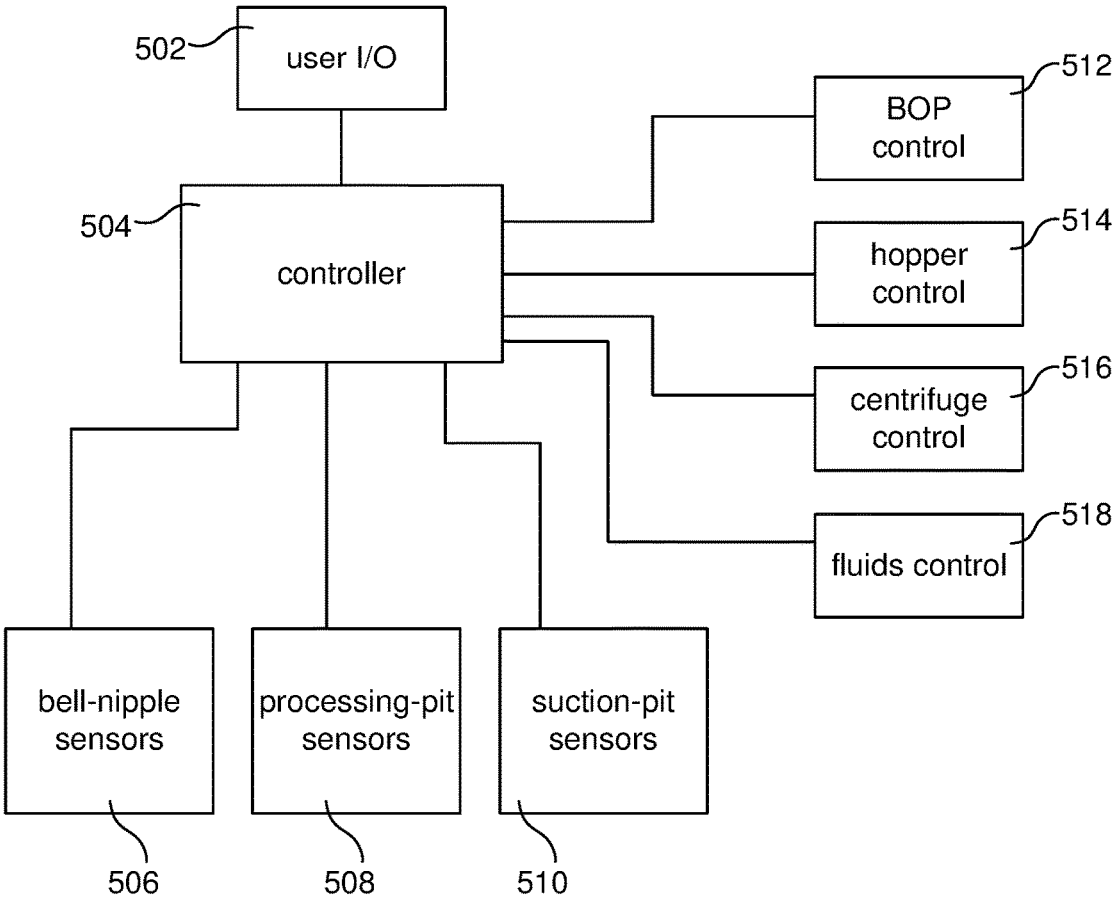
FIG. 5 illustrates an exemplary drilling-fluid monitoring system with controls for circulation-system components.

FIG. 5 depicts an exemplary drilling-fluid monitoring system according to the invention. The system includes a controller 504 (e.g., processor, application-specific integrated circuit, programmable logic device) connected to: (1) a user input/output system 502 (e.g., screen and keyboard/mouse, touchscreen, lights, sirens, bells), (2) a pair of vertically separated pressure sensors at the bell nipple 506, (3) a pair of vertically separated pressure sensors at the processing pit 508, (4) a pair of vertically separated pressure sensors at the suction pit 510, (5) a BOP control system 512 (e.g., controllable hydraulic or electric actuators), (6) a hopper control system 514 (e.g., controllable hydraulic or electric actuators), (7) a centrifuge control 516, and (8) a fluids control.

The controller 504 collects data from the sensors 506, 508, 510 and displays the information via the user input/output system 502. The user may respond to sensor information by instructing the controller to send signals to the BOP control 512, hopper control 514, or centrifuge control 516. For example, the user may respond to the sensor information by increasing the density of the drilling fluid by addition of product in a hopper. The control unit 504 can instruct the hopper control 514 to dispense an amount of product and engage the hopper to mix the product and drilling fluid. Likewise, the addition of fluids may be controlled by control unit 504 instructing the fluids control 518 to dispense an amount of fluids (e.g., water, oil) into the drilling fluid. Certain operations may be automated. For example, based on sensor information indicative of the amount of drilling fluid in the borehole (e.g., the height of the drilling fluid in the bell nipple or in a pit), the control unit 504 may automatically instruct the BOP control 512 to engage the blowout preventer to seal the borehole annulus from the surface to prevent a kick. In more extreme circumstances, the BOP control 512 may be engaged to completely seal the borehole from the surface (e.g., through activation of the shear rams).

Connections among the various components of the exemplary drilling-fluid monitoring system may be by any of a variety of conventional means, such as wires, wireless, and hydraulics. For example, a user interface 502 to the controller 504 may be provided on a smartphone, tablet, or laptop connected to the controller 504 through a wired or wireless network. Similarly, the sensors 506, 508, 510 may be connected to the controller 504 through wireless protocols such as BLUETOOTH or WIFI.

Figure 6:
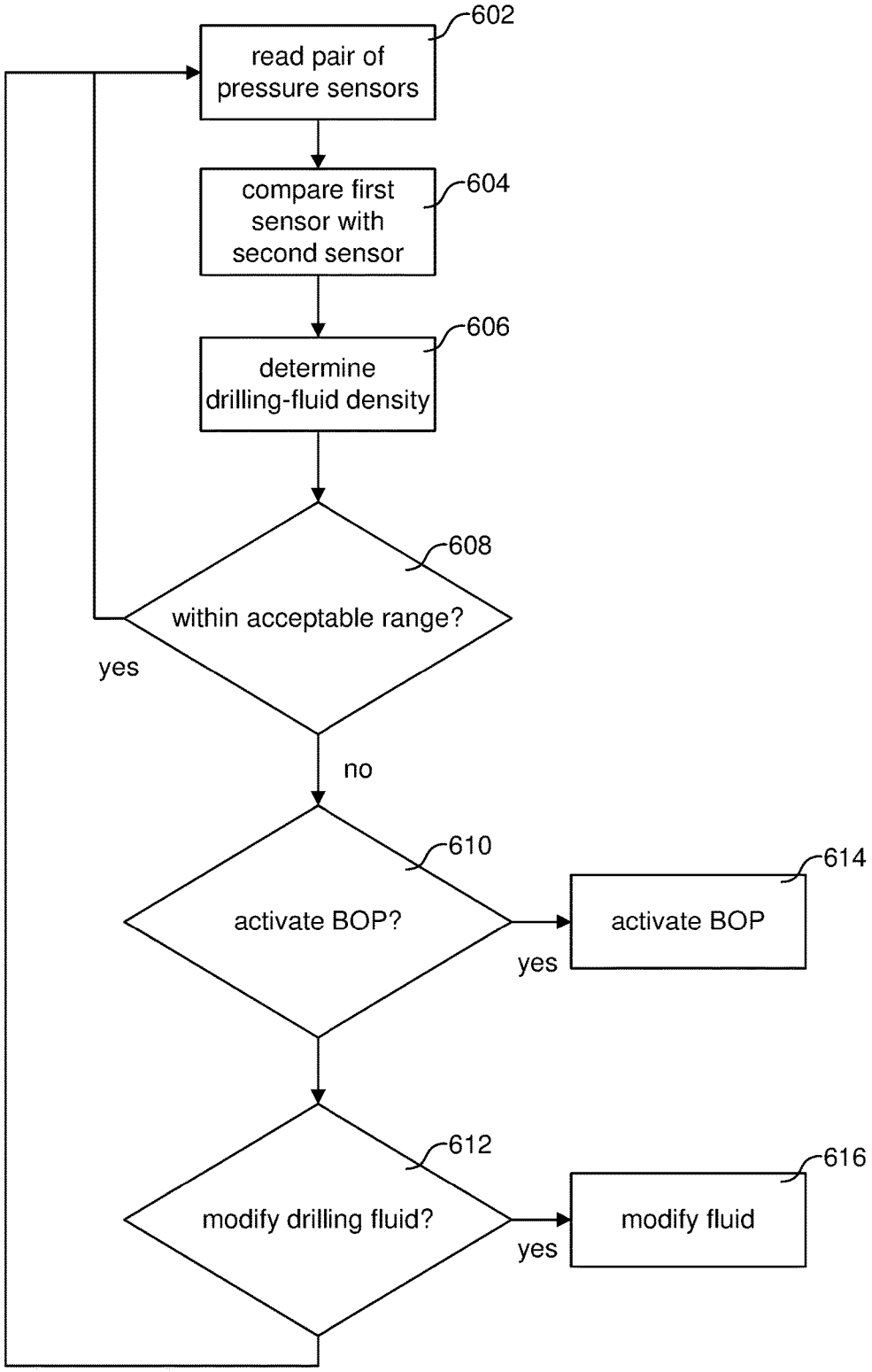
FIG. 6 illustrates an exemplary processing flow for monitoring a drilling-fluid circulation system during drilling operations.

FIG. 6 depicts an exemplary operational flow for a drilling-fluid circulation system according to the invention. Data is collected from a pair of vertically separated pressure sensors disposed in the circulation system of a drilling rig (e.g., at the bell nipple) 602. The pressure information from the two sensors is compared 604 and an estimate of drilling-fluid density is determined 606. The determined density is compared with a predetermined acceptable range 608. For example, the acceptable range may be a previously determined density plus or minus an acceptable variance or may be an absolute range of density values. The user can set the acceptable range. If the density is within the acceptable range, the drilling operation proceeds. If the density is not within the acceptable range, the system determines whether to activate the blowout preventer 610. For example, a determined density that is far below (or above) the acceptable range (e.g., 3 times the acceptable variance above or below a previously determined density), may indicate an unacceptable risk of a kick. If so, the system activates a blowout preventer 614 (e.g., to seal the return annulus from the surface or to shear the drill pipe and seal the well). The system may also determine whether the drilling fluid should be modified 612 and, if so, activate a hopper to add product to the drilling fluid. (This determination may proceed regardless of whether the blowout preventer was activated, or it may proceed only if the blowout preventer was not activated or only if activated in a certain way.) For example, a determined density that is too low may trigger the addition of solids to the drilling fluid to increase drilling-fluid density and a determined density that is too high may trigger the addition of fluids to the drilling fluid to decrease drilling-fluid density.

The bell-nipple drilling-fluid monitor may be used alone or in concert with drilling-fluid-pit monitors to provide real-time information of circulating conditions. This information can be used to better—and more safely—perform the drilling operation.

Figure 7:
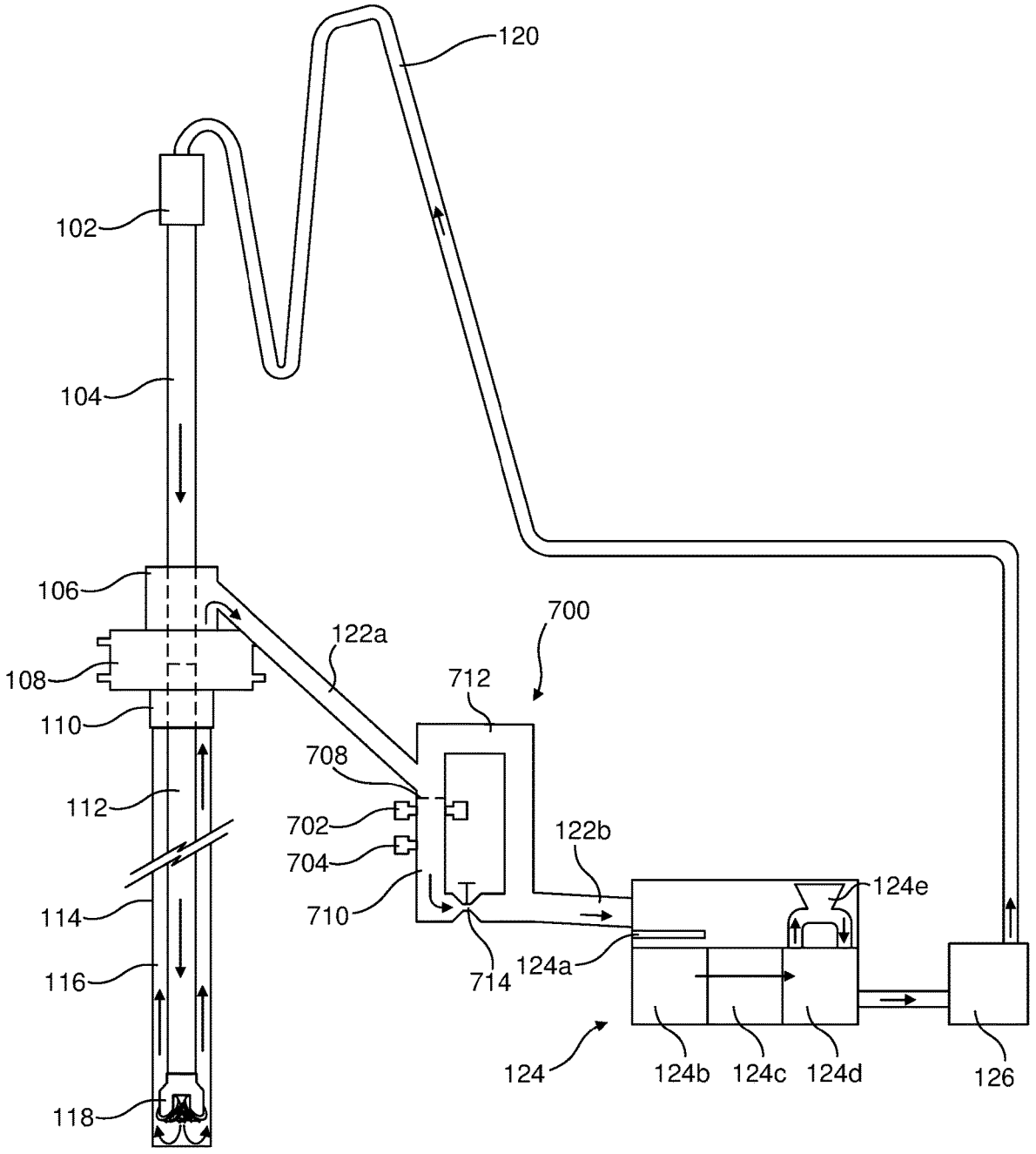
FIG. 7 illustrates the main components of a typical drilling-fluid circulation system as modified according to an aspect of the invention.

FIG. 7 depicts operation of a drilling rig's drilling-fluid circulation system that has been modified according to an aspect of the invention. The operation is similar to that described with reference to FIG. 2. The primary difference is that in the circulation system depicted in FIG. 7, a diverter 700 has been inserted into the flow line 122 connecting the bell nipple 106 to the drilling-fluid processing system 124 to thereby separate the flow line 122 into first and second sections 122*a*, 122*b*. The diverter 700 includes a first diverter flow line 710 that is oriented to create drilling-fluid height difference at the entry to the first diverter flow line 710 from the first flow-line section 122*a* and the exit at the second flow-line section 122*b*. Two inline pressure sensors 702, 704 are installed on the first diverter flow line 710 such that the that the first pressure sensor 704 is vertically lower than the second pressure sensor 702. (Together, the two pressure sensors 702, 704 are a pair of vertically separated pressure sensors.) Each pressure sensor 702, 704 is configured to provide a measure of pressure in the first diverter flow line 710. The diverter 700 also includes a choke valve 714 positioned in the first diverter flow line 710. The choke valve 714 may be used to adjust the flow through the first diverter flow line 710 and thereby to maintain a volume of drilling fluid in the first diverter flow line 710 with a surface level above the top sensor 702 (the surface level is shown in FIG. 7 as dashed line 708). The diverter 700 also includes a second diverter flow line 712 having an entry vertically above the entry to the first diverter flow line 710. The second diverter flow line 712 will accommodate drilling-fluid flow rates that are greater than the choke valve 714 setting by providing a flow path to the second flow line section 122*b* that bypasses the first diverter flow line 710 and the choke valve 714 when the drilling fluid overfills the first diverter flow line 710.

The pair of vertically separated pressure sensors 702, 704 operate similar to the pair 302, 304 described with reference to FIG. 3. Temperature or viscosity sensors may also be added to the first diverter flow line 710 to monitor the drilling fluid. In operation, the drilling fluid may be monitored in the diverter 700 rather than in the bell nipple 106. For example, the diverter 700 may be used with a rig configuration in which it is difficult to install a pair of vertically separated pressure sensors due to space or safety constraints. Change in the pressure in the first diverter flow line 710 (e.g., at the first 704 or the second 702 pressure sensor) over time indicates that the drilling-fluid surface level 708 in the first diverter flow line 710 is changing over time. This can indicate a loss of circulation or an imminent kick.

Multiple pairs of vertically separated pressure sensors may be installed at different vertical heights along a component of the circulation system to monitor for density variance along the vertical dimension. For example, multiple sensor pairs may be installed at various vertical positions along a riser stack connecting a sea-floor wellhead to a drilling platform, at various vertical positions along a string of surface casing, or at various positions along a drill string. Drilling-fluid density variance along the vertical direction could be detected by comparing the densities derived from different sensor pairs and the variance (or lack thereof) may be used to infer the state of the circulation system. For example, a greater drilling-fluid density at shallower vertical positions (nearer to the surface) than deeper vertical positions may indicate outgassing, in which dissolved gas bubbles out of the drilling-fluid when the drilling fluid falls below the bubble-point pressure. Advance notice of this outgassing may allow the rig operator to prepare for a gas kick.

While the foregoing description is directed to the preferred embodiments of the invention, other and further embodiments of the invention will be apparent to those skilled in the art and may be made without departing from the basic scope of the invention. And features described with reference to one embodiment may be combined with other embodiments, even if not explicitly stated above, without departing from the scope of the invention. The scope of the invention is defined by the claims which follow.

The invention claimed is:

1. A drilling-fluid circulation system comprising:

(a) a bell nipple;

(b) a flow line;

(c) a drilling-fluid process pit;

(d) a drilling-fluid suction pit;

(e) at least one pair of vertically separated pressure sensors included in one of the group consisting of the bell nipple and the flow line, wherein each pressure sensor of the pair is configured to measure a pressure of drilling fluid;

(f) at least one additional pair of vertically separated pressure sensors included in at least one of the group consisting of the drilling-fluid process pit and the drilling-fluid suction pit, wherein each pressure sensor of the pair is configured to measure a pressure of the drilling fluid; and (g) a controller connected to each of the at least one pair of vertically separated pressure sensors and the at least one additional pair of vertically separated pressure sensors.

2. The drilling-fluid circulation system of claim 1 wherein:

(a) the flow line includes a flow diverter comprising a first diverter line, a second diverter line, and a choke valve located in the first diverter line, wherein the choke valve is configured to selectively constrict flow of a drilling fluid through the first diverter line and the second diverter line is configured to handle flow of drilling fluid that is greater than that allowed to flow through the first diverter line; and (b) the at least one pair of vertically separated pressure sensors is included in the first diverter line.

3. The drilling-fluid circulation system of claim 1 wherein the controller is configured to perform an algorithm comprising:

(a) determine a first density of a drilling fluid using pressure information from the at least one pair of vertically separated pressure sensors;

(b) determine a second density of the drilling fluid using pressure information from the at least one additional pair of vertically separated pressure sensors;

(c) compare the first density to the second density; and (d) provide an indication of the comparison of the first density to the second density.

4. The drilling-fluid circulation system of claim 1 wherein the controller is configured to perform an algorithm comprising:

(a) determine a first density of a drilling fluid using first pressure information from the at least one pair of vertically separated pressure, wherein the first pressure information is acquired at a first time;

(b) determine a second density of a drilling fluid using second pressure information from the at least one pair of vertically separated pressure sensors, wherein the second pressure information is acquired at a first time;

(c) compare the first density to the second density; and (d) provide an indication of the comparison of the first density to the third density.

5. The drilling-fluid circulation system of claim 1 further comprising a blowout preventer actuator connected to the controller.

6. The drilling-fluid circulation system of claim 5 wherein the controller is configured to perform an algorithm comprising:

(a) determine a first density of a drilling fluid using first pressure information from the at least one pair of vertically separated pressure, wherein the first pressure information is acquired at a first time;

(b) determine a second density of a drilling fluid using second pressure information from the at least one pair of vertically separated pressure sensors, wherein the second pressure information is acquired at a first time;

(c) compare the first density to the second density; and (d) selectively activate the blowout preventer actuator based on the comparison of the first density to the second density.

7. The drilling-fluid circulation system of claim 1 further comprising a hopper actuator connected to the controller.

8. The drilling-fluid circulation system of claim 7 wherein the controller is configured to perform an algorithm comprising:

(a) determine a first density of a drilling fluid using pressure information from the at least one pair of vertically separated pressure sensors;

(b) determine a second density of the drilling fluid using pressure information from the at least one additional pair of vertically separated pressure sensors;

(c) compare the first density to the second density;

(d) selectively activate the hopper actuator based on the comparison of the first density to the second density.

9. The drilling-fluid circulation system of claim 1 further comprising at least one of the group consisting of a viscosity sensor positioned to provide a measure of drilling-fluid viscosity and a temperature sensor positioned to provide a measure of drilling-fluid temperature.

10. A drilling-fluid circulation system comprising:

(a) a bell nipple;

(b) a flow line comprising a first flow-line section, a flow diverter, and a second flow-line section;

(c) a drilling-fluid processing system comprising a process pit and a suction pit;

(d) wherein the first flow-line section is positioned to the bell-nipple side of the flow diverter and the second flow-line section is positioned to the drilling-fluid-processing-system side of the flow diverter; and (e) wherein the flow diverter includes a first diverter line, a second diverter line, and a choke valve located in the first diverter line, wherein the choke valve is configured to selectively constrict flow of a drilling fluid through the first diverter line and the second diverter line is configured to handle flow of drilling fluid that is greater than that allowed to flow through the first diverter line.

11. The drilling-fluid circulation system of claim 10 further comprising at least one pair of vertically separated pressure sensors positioned in the first diverter line.

12. A method for monitoring a drilling-fluid circulation system, the method comprising:

(a) determining a first density of drilling fluid, wherein the first density is of the drilling fluid at a point in the circulation system between a drill bit and a drilling-fluid processing system for cleaning the drilling fluid and wherein the first density is determined using pressure measurements from a first pair of vertically separated pressure sensors;

(b) determining a second density of drilling fluid, wherein the second density is of the drilling fluid at a point in the drilling-fluid processing system for cleaning the drilling fluid and wherein the second density is determined using pressure measurements from a second pair of vertically separated pressure sensors; and (c) comparing the first density to the second density.

13. The method of claim 12 further comprising activating a hopper actuator to add material to the drilling fluid based the comparison of the first density to the second density.

14. The method of claim 12 further comprising:

(a) determining a third density of drilling fluid, wherein the third density is of the drilling fluid at the same point as for the first density and wherein the third density is determined at a time later than the first density is determined; and (b) comparing the first density to the third density.

15. The method of claim 14 further comprising activating a blowout preventer actuator to close the blowout preventer based on the comparison of the first density to the third density.

16. The method of claim 14 providing an indication of a potential underbalanced condition if a difference between the first density and the third density exceeds a predetermined value.

* * * * *